US009190778B2

(12) United States Patent
Harris

(10) Patent No.: US 9,190,778 B2
(45) Date of Patent: Nov. 17, 2015

(54) GROUNDING PLUG SYSTEM FOR CABLES

(71) Applicant: Nelly Harris, Phoenix, AZ (US)

(72) Inventor: Nelly Harris, Phoenix, AZ (US)

( * ) Notice: Subject to any disclaimer, the term of this patent is extended or adjusted under 35 U.S.C. 154(b) by 0 days.

(21) Appl. No.: 14/454,586

(22) Filed: Aug. 7, 2014

(65) Prior Publication Data

US 2015/0079820 A1 Mar. 19, 2015

Related U.S. Application Data

(60) Provisional application No. 61/877,833, filed on Sep. 13, 2013.

(51) Int. Cl.

| | |
|---|---|
| ***H01R 13/652*** | (2006.01) |
| ***H01R 31/02*** | (2006.01) |
| ***H01R 24/78*** | (2011.01) |
| ***H01R 27/02*** | (2006.01) |
| ***H01R 31/06*** | (2006.01) |
| *H01R 103/00* | (2006.01) |
| *H01R 9/05* | (2006.01) |
| *H01R 24/30* | (2011.01) |

(52) U.S. Cl.

CPC ..... *H01R 13/652* (2013.01); *H01R 24/78* (2013.01); *H01R 27/02* (2013.01); *H01R 31/06* (2013.01); *H01R 9/0521* (2013.01); *H01R 24/30* (2013.01); *H01R 2103/00* (2013.01)

(58) Field of Classification Search

CPC .. H01R 13/652; H01R 31/02; H01R 2103/00; H01R 31/06; H01R 24/40

See application file for complete search history.

(56) References Cited

U.S. PATENT DOCUMENTS

| | | | | | |
|---|---|---|---|---|---|
| 3,268,847 | A | * | 8/1966 | Klumpp, Jr. | 439/105 |
| 3,382,355 | A | * | 5/1968 | Prifogle et al. | 362/641 |
| 3,493,915 | A | * | 2/1970 | Cox | 439/105 |
| 3,771,098 | A | * | 11/1973 | Dempsey | 439/101 |
| 4,081,206 | A | | 3/1978 | Lee | |
| 4,111,516 | A | * | 9/1978 | Wireman | 439/490 |
| 4,579,405 | A | * | 4/1986 | Hirooka | 439/106 |
| 4,824,382 | A | * | 4/1989 | Ryan | 439/105 |
| 4,875,864 | A | | 10/1989 | Campbell | |
| 5,597,314 | A | | 1/1997 | Auclair et al. | |
| 5,722,841 | A | | 3/1998 | Wright | |
| 6,533,466 | B1 | * | 3/2003 | Smith | 385/75 |
| 6,767,255 | B1 | * | 7/2004 | Croswell | 439/651 |
| 6,843,664 | B2 | * | 1/2005 | Belson et al. | 439/105 |
| 7,040,931 | B1 | * | 5/2006 | Achtner et al. | 439/651 |
| 7,220,136 | B1 | * | 5/2007 | Green | 439/106 |
| 7,422,453 | B2 | | 9/2008 | Malin | |
| 8,790,123 | B2 | * | 7/2014 | Ku et al. | 439/95 |

* cited by examiner

*Primary Examiner* — Gary Paumen

(74) *Attorney, Agent, or Firm* — Steptoe & Johnson LLP

(57) ABSTRACT

A ground cable plug assembly configured to accept a cable and provide necessary connections for accomplishing a grounding function. In one approach, the cable plug assembly is configured to accept and ground a coaxial cable. In another approach, the cable plug assembly accepts and grounds an HDMI cable.

2 Claims, 7 Drawing Sheets

FIG. 3A
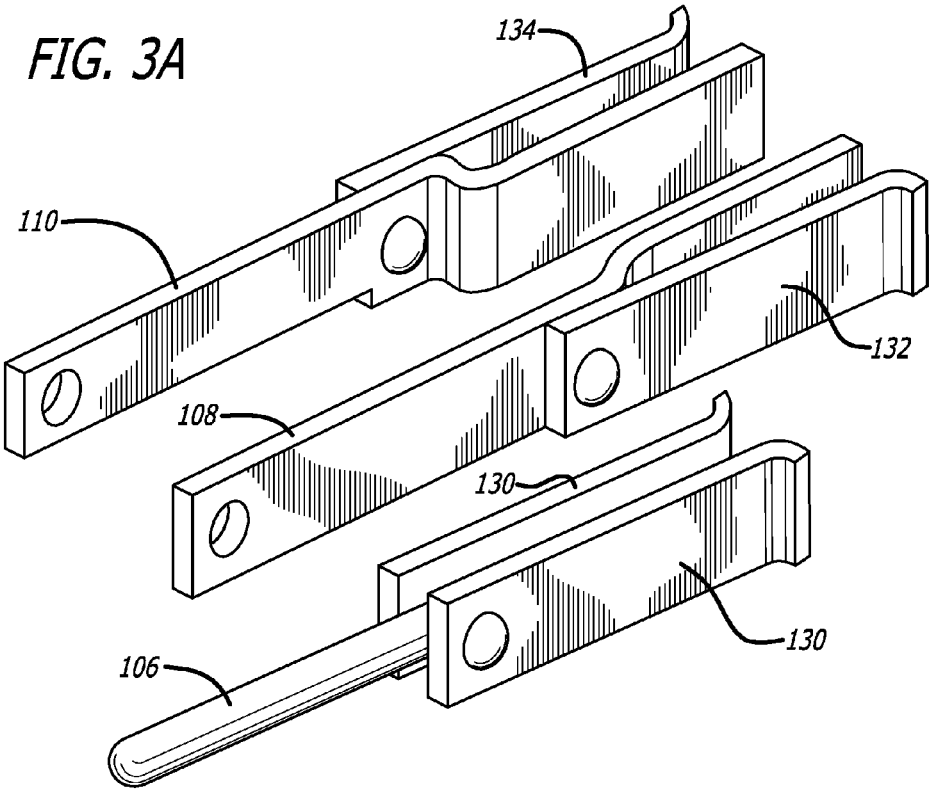
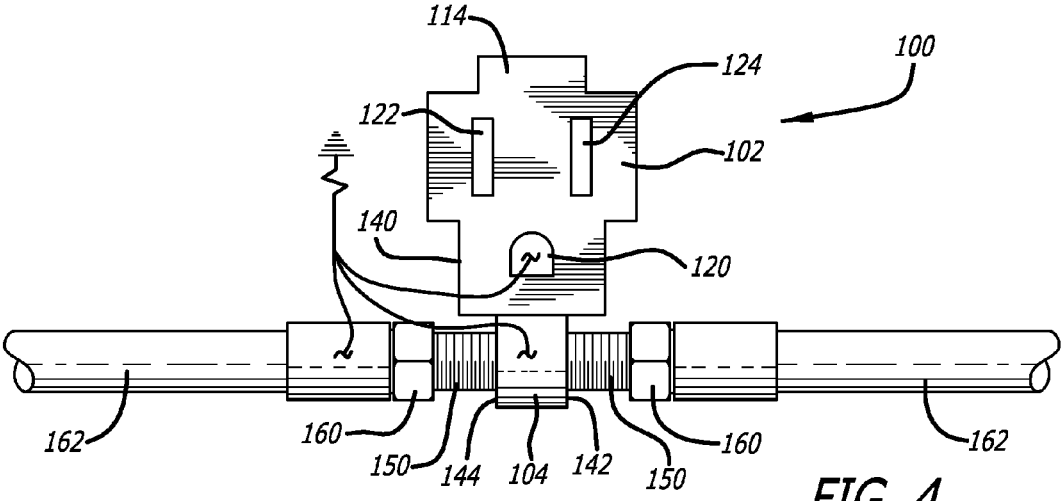
FIG. 4

GROUNDING PLUG SYSTEM FOR CABLES

CROSS-REFERENCES TO RELATED APPLICATIONS

This application claims the benefit of U.S. Application Ser. No. 61/877,833, filed Sep. 13, 2013, the entire disclosure of which is expressly incorporated herein.

BACKGROUND

The present invention relates generally to electrical grounding, and more particularly to grounding coaxial, HDMI and other cables.

Companies that operate fiberoptic and wired, third-party distribution systems for broadcast programming are subject to electrical grounding regulations. These operators deliver television programming received from cable networks or local television stations to consumers via coaxial cable or fiber optic infrastructure on a subscription basis. Cable providers also offer internet access and internet-protocol telephone services, (sometimes referred to as Voice over Internet Protocol or VoIP) usually as a package, bundled together with a cable TV and broadband subscription. These companies rely on equipment provided by component and equipment manufacturers to provide that final connection inside businesses and homes of their subscribers for their entertainment and communications devices and needs.

A coaxial cable, is a type of cable that has an inner conductor surrounded by a tubular insulating layer, surrounded by a tubular conducting shield. Coaxial cables can also have an insulating outer sheath or jacket The term coaxial is derived from the inner conductor and the outer shield sharing a geometric axis. Coaxial cables differ from other shielded cable used for carrying lower-frequency signals, such as audio signals, in that the dimensions of the cable are controlled to give a precise, constant conductor spacing, which is needed for it to function efficiently as a radio frequency transmission line.

A continuous current, along the imperfect shield of a coaxial cable can cause visible or audible interference. In CATV systems, distributing analog signals the potential difference between the coaxial network and the electrical grounding system of a house can cause a visible distortion in the picture. This appears as a wide horizontal bar in the picture that scrolls slowly upward. Such differences in potential can be reduced by proper bonding to a common ground at the house.

HDMI (High-Definition Multimedia Interface) is a compact audio/video interface for transferring uncompressed video data and compressed/uncompressed digital audio data from a HDMI-compliant device to a compatible computer monitor, video projector, digital television, or digital audio device. HDMI is a digital replacement for existing analog video standards.

There are a number of HDMI-standard cable connector available, each of which can be used for any uncompressed TV or PC video format, including standard, enhanced, high definition, and 3D video signals; up to 8 channels of compressed or uncompressed digital audio; a CED (Consumer Electronics Control) connection; and an Ethernet data connection. HDMI implements the EIA/CEA-861 standards, which define video formats and waveforms, transport of compressed, uncompressed, and LPCM audio, auxiliary data, and implementations of the VESA EDID. One of the 19 or 29 pins configured at the head of a connection of the HDMI cable is provided for grounding.

AC power plugs and sockets are devices that allow electrically operated equipment to be connected to the primary alternating current (AC) power supply in a building. Electrical plugs and sockets differ in voltage and current rating, shape, size and type of connectors. The types used in each country are set by national standards.

Electrical sockets for single phase domestic, commercial and light industrial purposes generally provide either two or three electrical connections to the supply conductors. All two pin sockets provide neutral and line connections, both of which carry current and are defined as live parts. Neutral is usually at or very near to earth potential, usually being earthed either at the distribution board or at the substation. Line carries the full supply voltage relative to the neutral and to earth. Three pin sockets provide, in addition, a protective earth connection. This allows the exposed metal parts of the appliance to be connected to earth (also known as ground), providing protection to the user should those exposed parts inadvertently come into contact with any live parts within the appliance. Some sockets may carry two line connections, each at half the supply voltage relative to the neutral but the full voltage relative to each other.

The third contact for a connection to earth is intended to protect against insulation failure of the connected device. When earthed distribution systems became common, earlier unearthed socket types were either replaced with new standards, or revised to include an earthing pin.

The National Electrical Code (NEC), Article 820-40 requires that the CATV Cable ground be connected to the ground system of the building. This requires that the original installation of the cable system in the building be grounded, properly, and relies on the metal sheath around the cable to ground the cable box. The problem is that the cable connections are not always properly grounded as they enter the structure and there are typically multiple cable interfaces between the cable coming into the building and the cable box or other devices in the building. This results in ungrounded and/or improperly grounded cables connecting to the media or cable box. The domino effect, presents as poor transmission signals and electromagnetic interference which take significant time, effort and expense to resolve as well as unhappy customers.

Accordingly, what is needed is an approach to grounding cable connections without adding to the complexity of the cables themselves or to the grounding system provided by a building. Such grounding arrangements are described for both coaxial and HDMI as well as other cables. The present disclosure addresses these and other needs.

SUMMARY

Briefly and in general terms, the present disclosure is directed towards an electrical grounding device, system and method for a cable. The electrical grounding device can be embodied in an electrical plug assembly including grounding structure configured to interface with complementary structure of a cable.

In one approach, there is disclosed a component device that provides grounding of a coaxial or HDMI cable to the same grounding circuit that provides power to a building at the point of use. This cable grounding plug provides electrical grounding for cable devices that previously were not grounded properly or at all. By providing grounding of the coaxial or HDMI cables inside the building at the point of use, the cable providers solve significant service and maintenance issues regarding suboptimal signals caused by improper or poor grounding.

In one embodiment, a cable ground plug assembly embodies a housing including a main body having a plurality of faces and an extension body projecting from the main body, the extension including a pair of female sockets. One face of the main body includes a plurality of electrodes, prongs or pins extending therefrom, one corresponding to a hot slot of a socket, one corresponding to a neutral slot of a socket and a third corresponding to a ground slot of a socket. On an opposite face of the main body there can be slotted holes including a hot slot, a neutral slot and a ground slot. The extension body projecting from the main body includes an electrical connection including a pair of opposed female receptacles for a cable, the electrical connection being connected to the ground electrode or pin. In one embodiment, the female receptacles accept terminal end adapters of a coaxial cable. In another embodiment, the female receptacles accept terminal end adapters of a HDMI cable.

Other features and advantages of the present invention will become apparent from the following detailed description, taken in conjunction with the accompanying drawings, which illustrate, by way of example, the principles of the invention.

BRIEF DESCRIPTION OF THE DRAWINGS

FIG. 3A are perspective views, depicting terminal ends of prongs of a grounding plug assembly;

FIG. 4 is a front view, depicting the cable grounding plug of FIG. 1 accepting a coaxial cable;

DETAILED DESCRIPTION OF THE PREFERRED EMBODIMENTS

Figure 1:
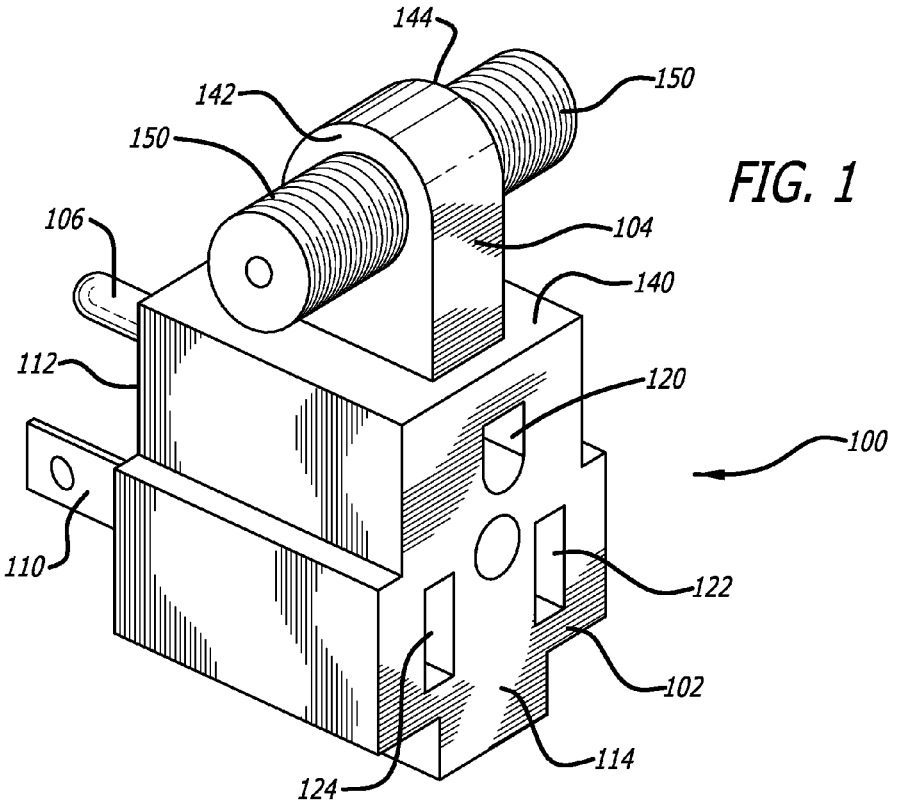
FIG. 1 is a perspective view, depicting one embodiment of a cable grounding plug assembly.

Referring now to the drawings, not as a limitation but by way of example, there is presented a cable ground plug assembly for providing a ground for a cable assembly.

Figure 2:
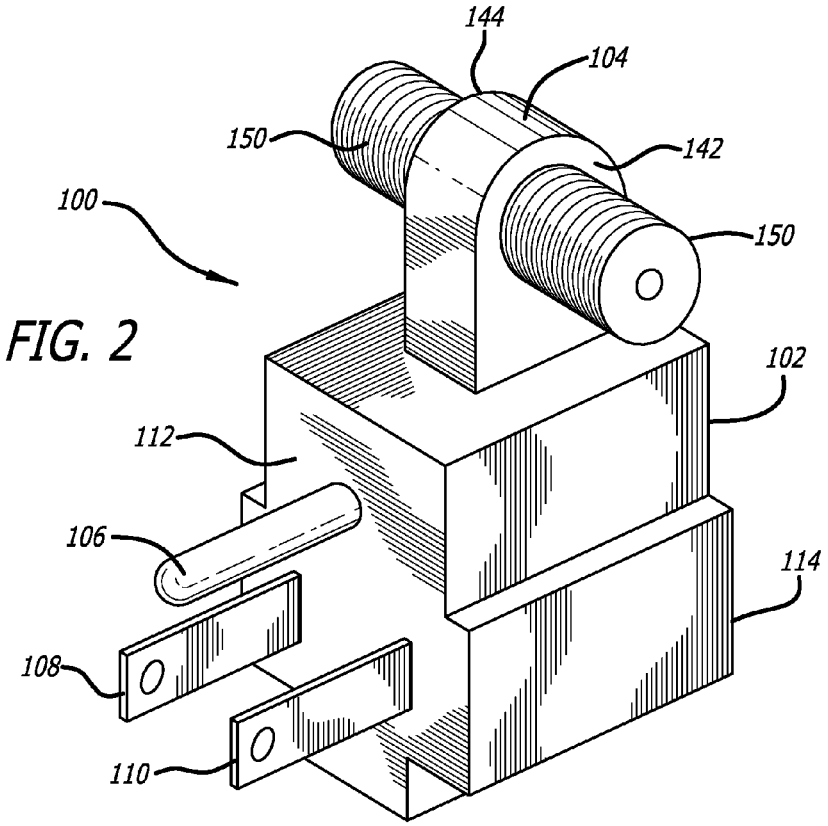
FIG. 2 is a rotational view, depicting the cable grounding plug of FIG. 1.
Figure 3:
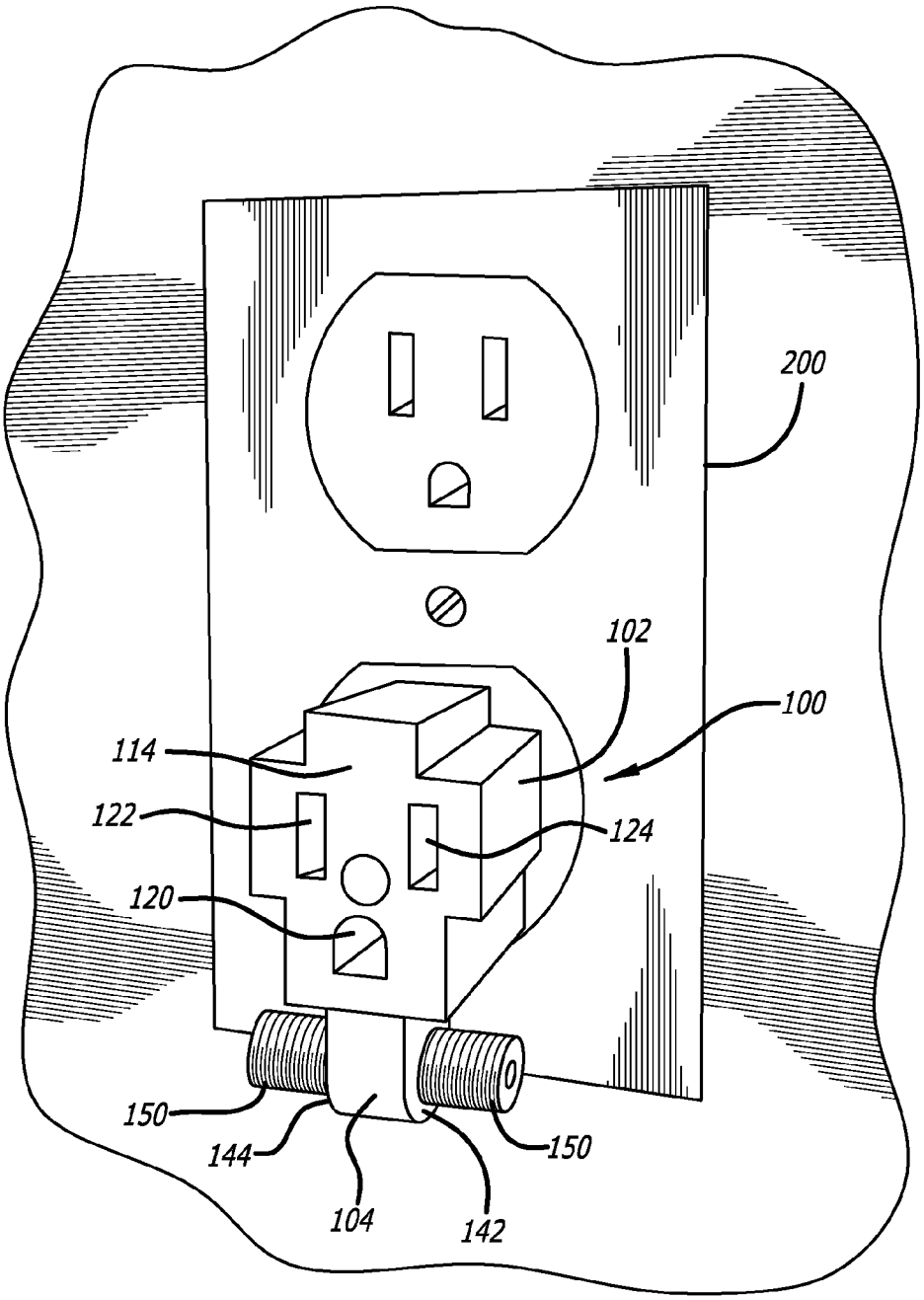
FIG. 3 is another perspective view, depicting the cable grounding plug of FIG. 1 plugged into a wall socket.

Referring to FIGS. 1-3, there is shown a cable grounding plug assembly or housing 100. The cable grounding plug assembly 100 includes a main body 102 and an extension body 104 projecting therefrom. The main body 102 houses conventional plug structures and supports a ground prong 106, a relatively larger neutral prong 108, and a hot prong 110. The prongs extend generally perpendicularly from a first face 112 of the main body 102.

A second face 114 of the main body 102 can be configured to be spaced and generally parallel to the first face 112. Formed within the second face 112 are a plurality of openings. A first opening 120 is sized and shaped to receive a conventional ground prong. A second opening 122 is sized and shaped to receive a neutral prong and a third opening 124 is sized and shaped to receive a hot prong. Such holes provide access to proximal terminal ends of the ground 106, neutral 108 and hot 112 prongs retained by the housing. With reference to FIG. 3A, the proximal ends of the ground 106, neutral 108, and hot 110 prongs can be configured with leaf springs 130, 132, 134 of various sizes, or other structure, to releasably engage corresponding terminal ends of a plug which is inserted within the second face 114 of the main body 102 of the housing 100.

In one embodiment, the extension body 104 of the cable grounding plug assembly 100 extends in a direction generally parallel to the first 112 and second 114 faces of the main body 102, and from a third face 140 of the main body 102. The extension body 104 is in direct connection with the ground prong 106 so as to provide a path for grounding a coaxial or other cable. The extension body 104 can present additional opposing faces 142, 144 which can be generally perpendicular to planes extending through the first 112 and second 114 faces.

Figure 5:
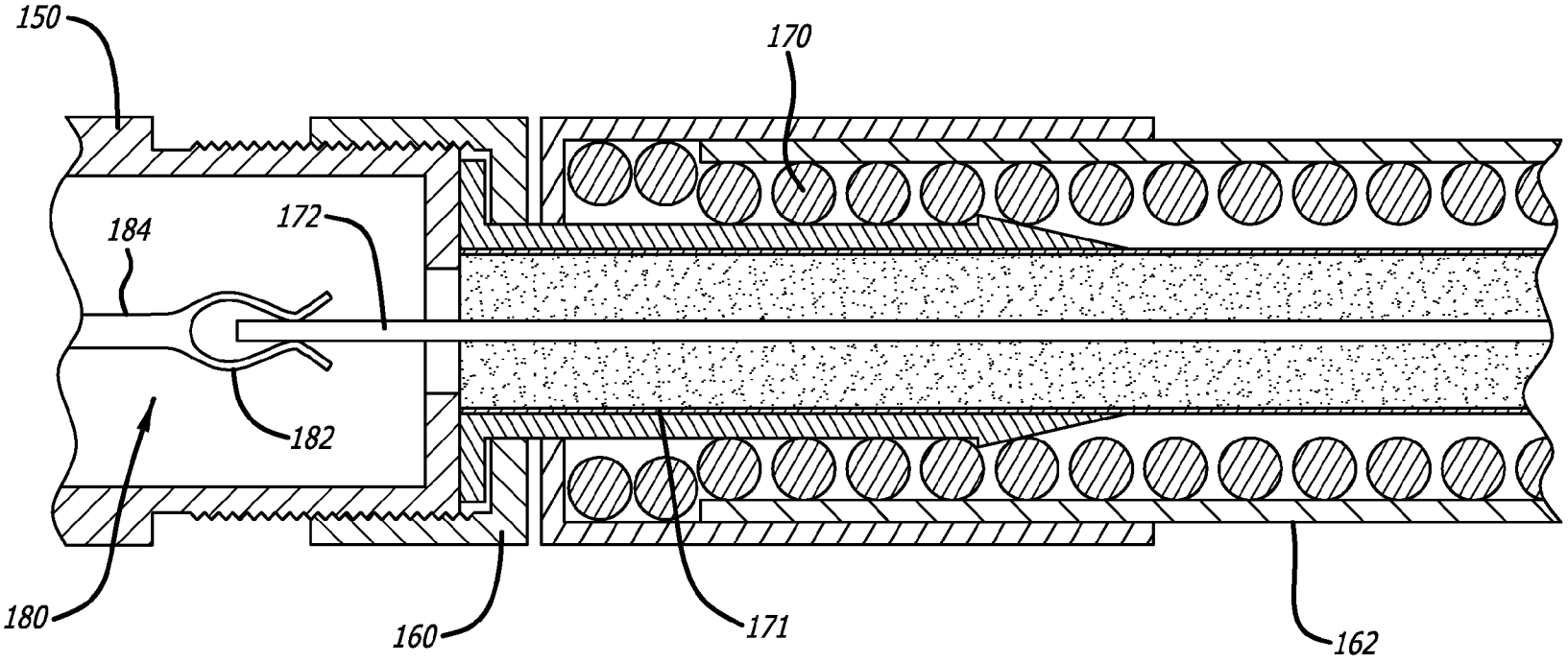
FIG. 5 is a cross-sectional view, depicting a ground connection of a coaxial cable to the cable grounding plug of FIG. 1.

Extending generally perpendicular to and one from each of the opposing faces 142, 144 can be a threaded female receptacle 150. The threaded female receptacles 150 are sized and shaped to matingly receive and engage with conventional male ends 160 of a coaxial cable 162 (See FIG. 4). As best seen in FIG. 5, the coaxial cable 162 has an elongate profile with a coax cable outer braided wire 170 extending along its length, as well as an outer conductor 171. Also extending a length of the cable is a coax cable center conductor 172. Further, configured within each of the threaded female receptacles 150 is a coax cable conductor leaf spring assembly 180 which includes first and second leaf springs 182 (only one shown) which are each sized and shaped to releasably engage and electrically connect to one cable center conductor 172. The leaf spring assembly 180 includes a mid-body 184 that extends to the leaf spring (not shown) which is in turn connected to the cable center connector of a second coaxial cable. The coaxial cable itself 162 is grounded in a conventional manner through the interconnection of the terminal end 160 of the coaxial cable to the female receptacle, to the ground plug in the main body, and to the wall socket.

Figure 6:
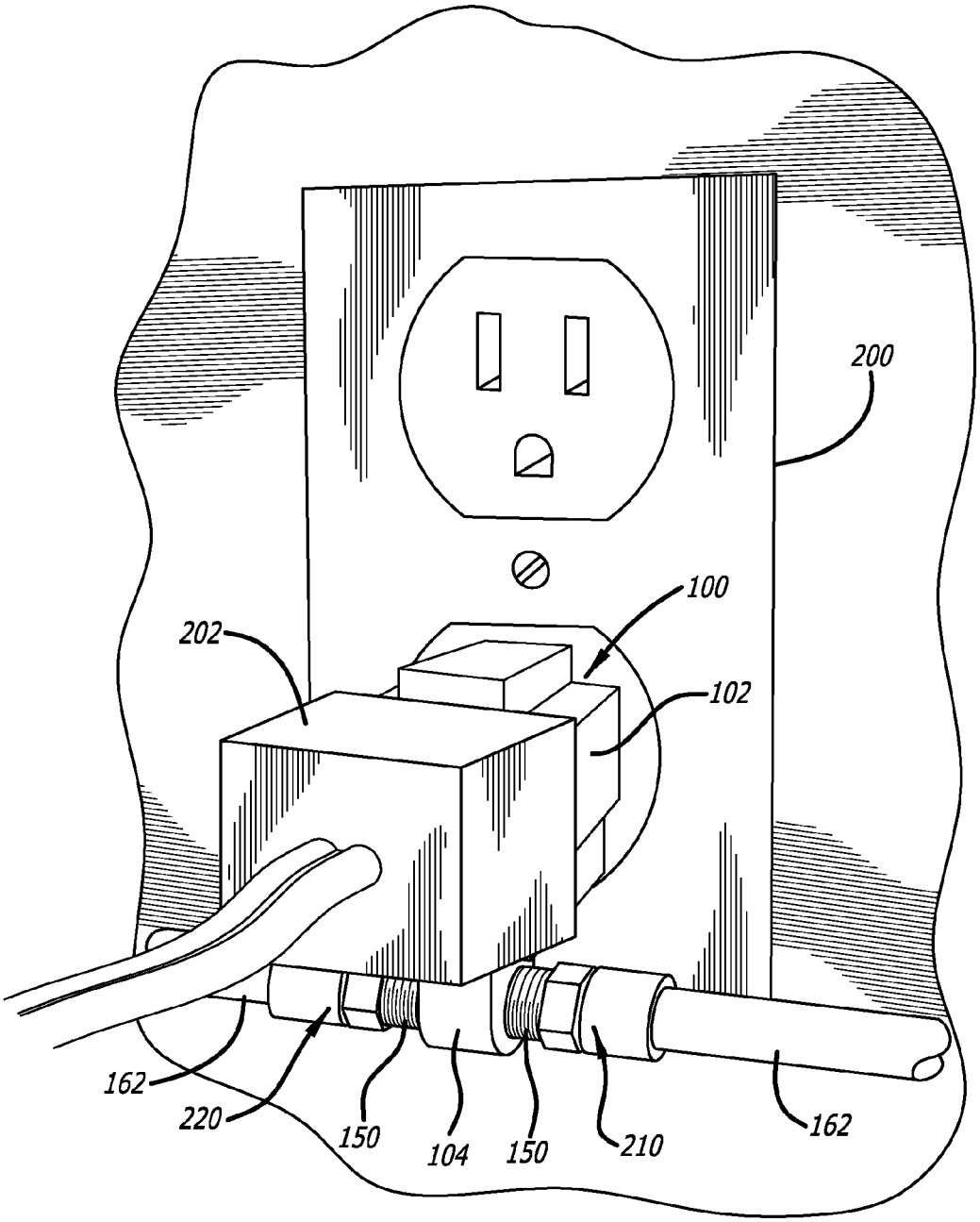
FIG. 6 is a perspective view, depicting the cable ground plug of FIG. 1 accepting a conventional electrical plug and coaxial cable.

A completed or connected assembly is shown in FIG. 6. The cable grounding plug assembly 100 is shown plugged into a wall socket 200. Also, a terminal plug end 202 of an electronic device is shown plugged into the main body 102 of the plug assembly 100. Further, a pair of coaxial cables 162 are each individually electrically grounded through their connection to the threaded female receptacles 150. In practice, a coaxial cable 162 coming into the building will have, for example, a terminal end 210 connected to a first threaded female receptacle 150, and an extension coaxial cable will have a terminal end 220 connected to a second threaded receptacle 150. The extension coaxial cable will be connected to the communication or cable box (not shown), and present a grounded electrical connection.

Figure 7:
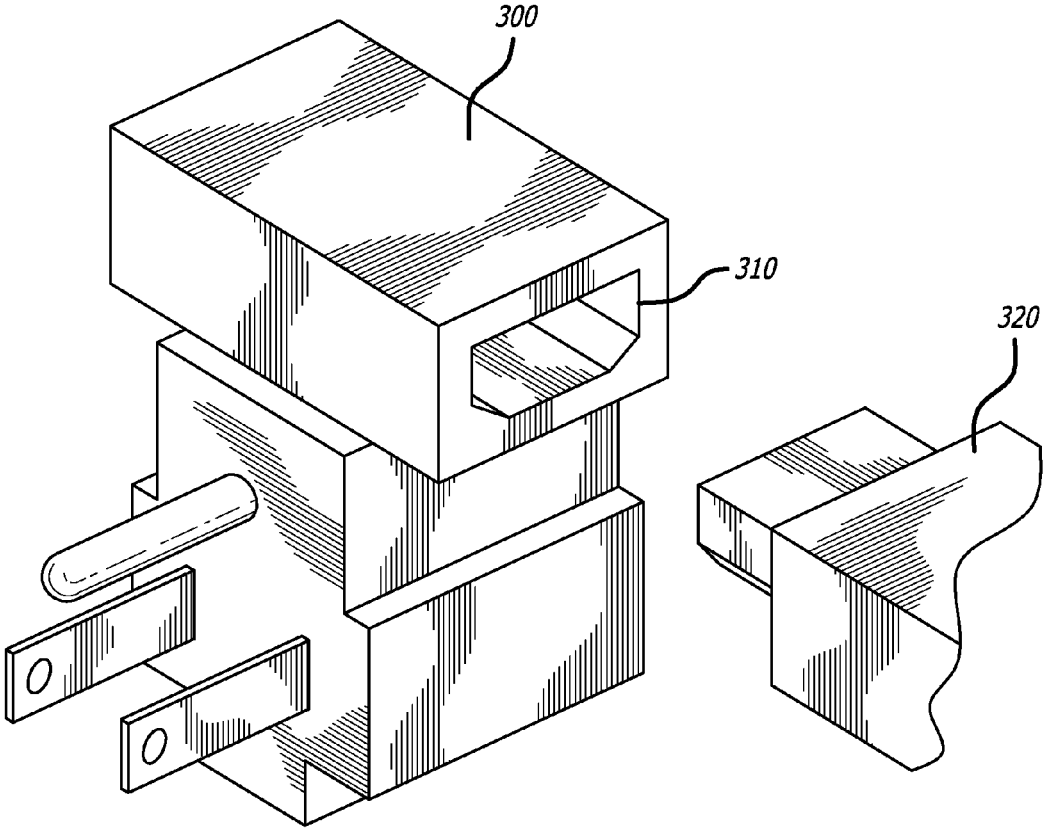
FIG. 7 is a perspective view, depicting another embodiment of a cable ground plug.
Figure 8:
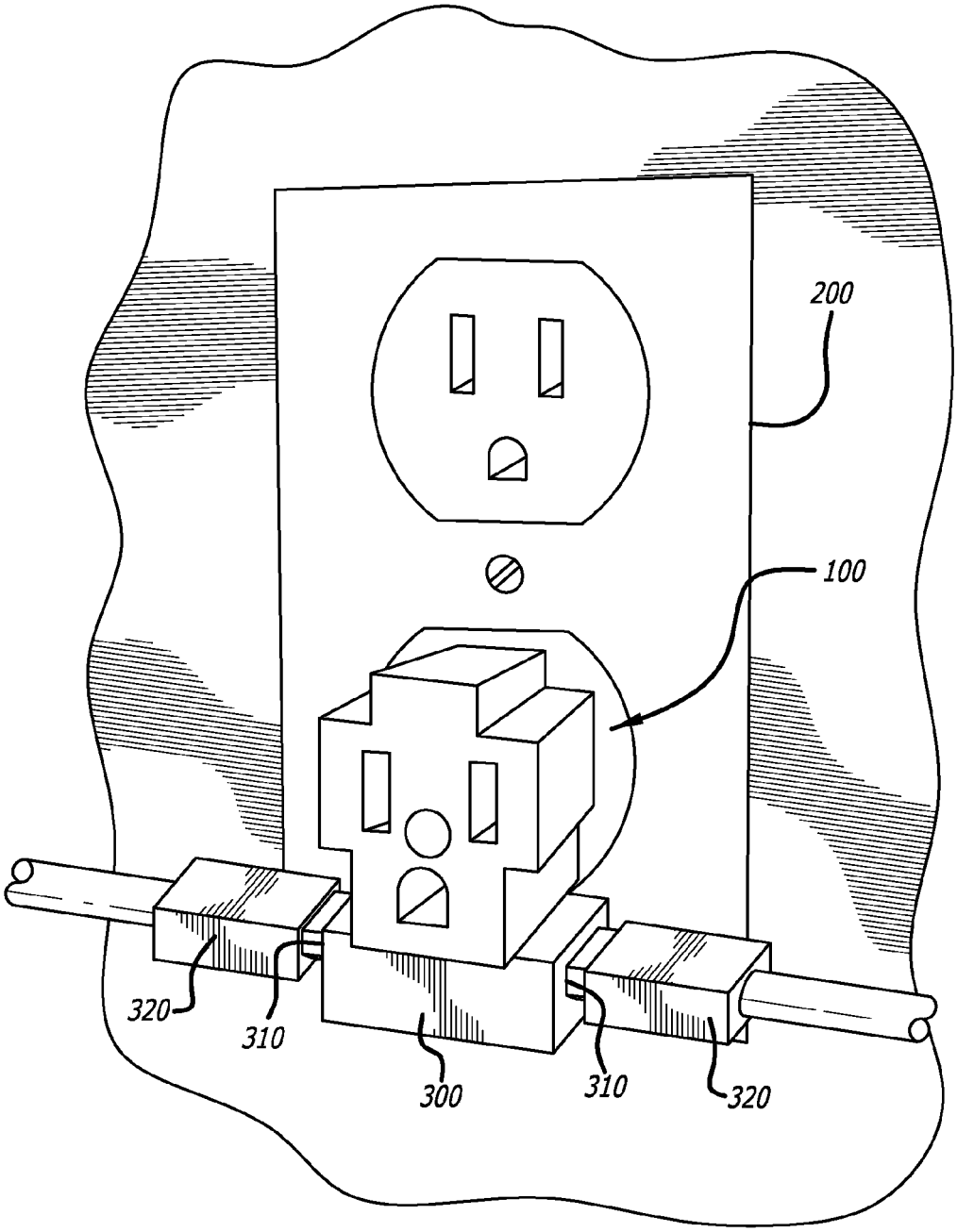
FIG. 8 is a front view, depicting the cable ground plug of FIG. 7 accepting an HDMI cable.

As shown in FIGS. 7 and 8, the cable grounding plug assembly 100 can be alternatively configured with an extension body 300 including a pair of HDMI female receptacles 310 sized and shaped to receive male terminal ends of conventional HDMI cables 320. The grounding pin (not identified) of the HDMI cables 320 can be electrically routed to the grounding structure of the cable grounding plug assembly 100. Further, the HDMI extension body 300 is configured to electrically connect a first HDMI cable coming into a building with a second extension HDMI cable placed in connection with a cable or other communication box or device (See FIG. 8).

Thus, it will be apparent from the foregoing that, while particular forms of the invention have been illustrated and described, various modifications can be made without parting from the spirit and scope of the invention.

I claim:

1. A method for grounding a cable, comprising:

providing a grounding plug assembly including a main body and an extension housing projecting therefrom, the exterior housing including first and second female cable receptacles;

placing the grounding plug assembly in a wall socket;

attaching a male end of a first cable within the first female cable receptacle;

grounding the first cable through the wall socket;

attaching a male end of a second cable within the second female cable receptacle;

placing the second cable in communication with the first cable; and attaching a second male end of the second cable to a communication device.

2. A system for grounding a cable comprising:

a wall outlet including a ground;

a first cable with a first male end;

a second cable with a second male end; and a grounding plug assembly including a main body with a ground prong, and an extension housing exterior from the main body, the exterior housing including a first female receptacle, a second first receptacle and a connection to the ground prong;

wherein the first cable is attached to the first female receptacle and grounded to the wall ground, the second cable is attached to the second female receptacle, and the first cable is placed in electronic communication with the second cable.

* * * * *